US006036246A

United States Patent [19]

Liedtke

[11] Patent Number: 6,036,246

[45] **Date of Patent: *Mar. 14, 2000**

[54] DEVICE FOR MANIPULATING SUBMERGED-OPERATING UNITS

[75] Inventor: Roland Liedtke, Hannover, Germany

[73] Assignee: ITT Flygt AB, Solna, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/753,164

[22] Filed: Nov. 21, 1996

[30] Foreign Application Priority Data

Nov. 22, 1995 [DE] Germany ..... 195 43 525

[51] Int. Cl.[7] ..... B66C 1/10

[52] U.S. Cl. ..... 294/66.1; 294/82.31

[58] Field of Search ..... 294/66.1, 67.1, 294/82.31, 82.24

[56] References Cited

U.S. PATENT DOCUMENTS

| | | | |
|---|---|---|---|
| 186,943 | 2/1877 | Moore | 294/67.1 |
| 2,445,106 | 7/1948 | Dempster | 294/82.31 |
| 3,311,401 | 3/1967 | Bacon | 294/82.31 |
| 3,416,832 | 12/1968 | Rice | 294/82.24 |
| 3,853,082 | 12/1974 | Rosenberg et al. | 294/82.32 |
| 4,009,635 | 3/1977 | Munro et al. | 294/66.1 |
| 4,015,873 | 4/1977 | Langguth | 294/66.1 |
| 4,817,780 | 4/1989 | Davidsson | 294/82.31 |

FOREIGN PATENT DOCUMENTS

| | | | |
|---|---|---|---|
| 0304797 | 3/1989 | European Pat. Off. | 294/82.31 |
| 668061 | 10/1929 | France | 294/82.31 |

*Primary Examiner*—Katherine Matecki
*Attorney, Agent, or Firm*—Menotti J. Lombardi

[57] ABSTRACT

A device (10) for manipulating submerged-operating units (11), such as submersible motor-driven pumps, submersible motor-driven stirrers and the like, has a hoist, by means of which the unit (11) can be brought into a submerged working position and a surfaced maintenance position, wherein the unit (11) is provided with a lifting strap (25) of a coupling unit, whose coupling element (60, 60'), which can be brought into and out of engagement with the lifting strap (25), is provided on a pulling element (48) of the hoist. In order to be able to design the device for manipulating submerged-operating units mechanically more simply and to use it also without a guide device, it is provided that the coupling element is formed from a first bridge-like drop bar (60) for lowering the unit (11), or a second bridge-like drop bar (60') for lifting the unit (11), on which the lifting strap (25) rests during the lowering or raising of the unit (11), and that in the unstressed state the first drop bar (60) automatically takes up its opening position, and the second drop bar (60') automatically takes up its closed position.

4 Claims, 3 Drawing Sheets

DEVICE FOR MANIPULATING SUBMERGED-OPERATING UNITS

FIELD OF THE INVENTION

The instant invention relates to a device for manipulating submerged-operating units, such as submersible motor-driven pumps, submersible motor-driven stirrers and the like.

BACKGROUND OF THE INVENTION

The coupling element of such as device for manipulating of submerged-operating units known from DE 28 49 887 A1 is formed by a hook, which is seated on a spacer and is pivotable in respect to a guide device. Coupling the hook with and uncoupling it from the strap of the unit can be achieved by means of a lever, on which the hook acts, and a spring arrangement. Since for placement of the hook on the strap, it must be placed in an exactly predetermined directed manner, a guide device is imperative in connection with the known manipulating device. Further than that, because it is intended to be lowered and lifted, the mechanical portion of the manipulating device is relatively awkward to handle, elaborate and in particular of a large size.

It is therefore the object of the instant invention to provide a device for manipulating submerged-operating units of the species mentioned at the outset, which are mechanically simpler designed and which can also be employed without a guide device.

SUMMARY

A device for manipulating submerged-operating units, such as submersible motor-driven pumps, submersible motor-driven stirrers and the like, having a hoist, by means of which the unit can be brought into a submerged working position and a surfaced maintenance position, wherein the unit is provided with a lifting strap of a coupling unit, whose coupling element, which can be brought into and out of engagement with the lifting strap, is provided on a pulling element of the hoist, characterized in that the coupling element is formed from a first bridge-like drop bar for lowering the unit or a second bridge-like drop bar for lifting the unit, on which the lifting strap rests during the lowering or raising of the unit, and that in the unstressed state the first drop bar automatically takes up its opening position, and the second drop bar automatically takes up its closed position.

DESCRIPTION OF THE DRAWINGS

Further details of the invention can be taken from the subsequent description, in which the invention is described in detail and explained by means of the exemplary embodiment represented in the drawings. Shown are in.

DESCRIPTION OF THE INVENTION

Figure 1:
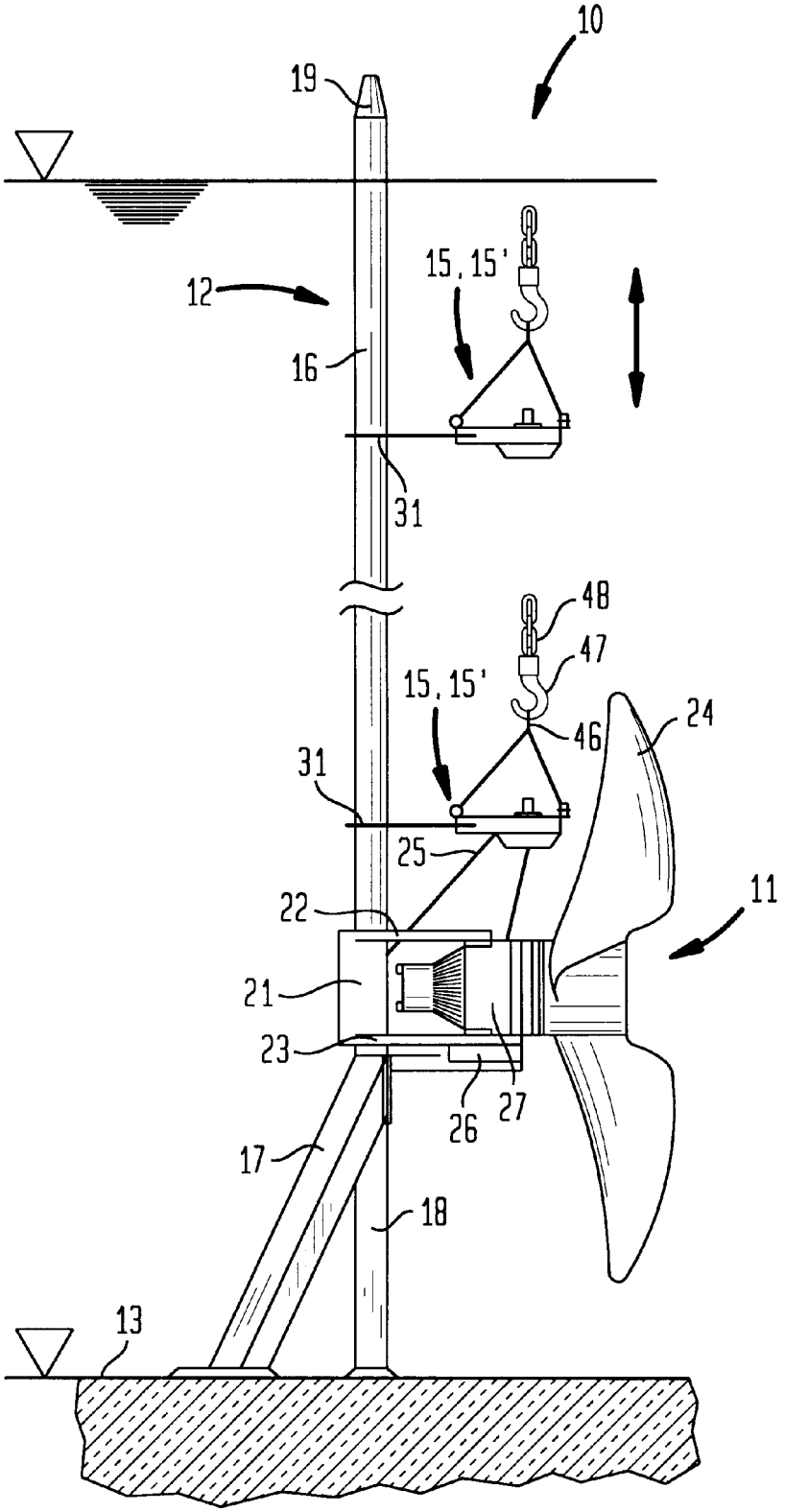
FIG. 1 a lateral view of a device for manipulating a submerged-operating unit in a locked and released arrangement of a catch device in respect to a unit.

A unit 11, held in the working position on a guide device 12, is represented in FIG. 1, and can be moved downward or can be moved upward along the guide device 12 by means of a catch device 15 for lowering the unit 11, or by means of a catch device 15' for raising the unit 11. The catch device 15 or 15' is a part of a manipulating device 10 in accordance with the invention and is connected with a hoist, not represented, via a pulling element 48.

In the represented exemplary embodiment, the guide device 12 is constituted by an upright pipe 16 which is placed, fastened and rigidly held by means of struts 17, 18 on the bottom 13 of, for example, a reservoir or a shaft or the like, not further shown. The unit 11 is guided by means of a sliding claw 21 along the upright pipe 16, in this case only a single one, which is provided with a taper 19 on its upper end. In this case the unit 11 is represented as a submersible motor-driven stirrer and it is understood that it can also be a submersible motor-driven pump or the like. On its upwardly oriented side between the sliding claw 21 and and stirrer blade 24, which is connected with a motor 27, the unit 11 is held on the sliding claw 21 by means of horizontal arms 22, 23 and is provided with a catch or lifting strap 25. In the drawing representation of FIG. 1 the unit 11 is in its lower working position, in which it rests on a detent 26 fastened on the upright pipe 16.

Figure 2:
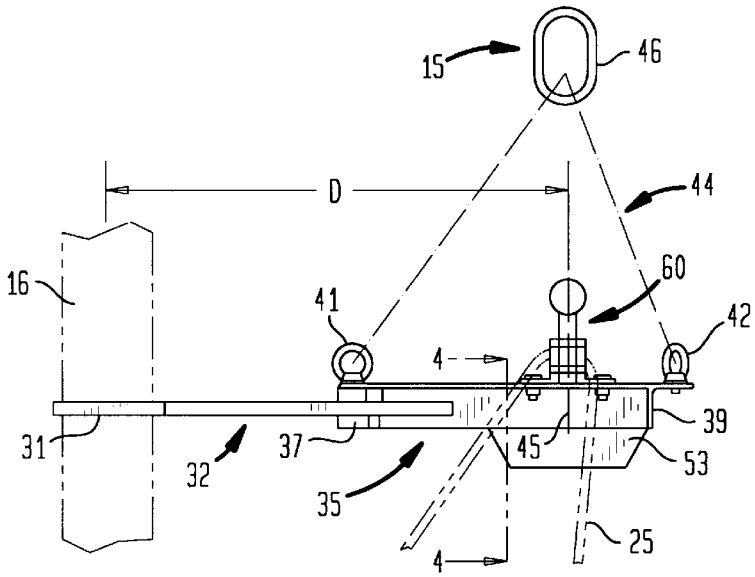
FIG. 2 a catch device for lowering a unit in accordance wit a preferred exemplary embodiment of the instant invention in an enlarged representation.
Figure 3:
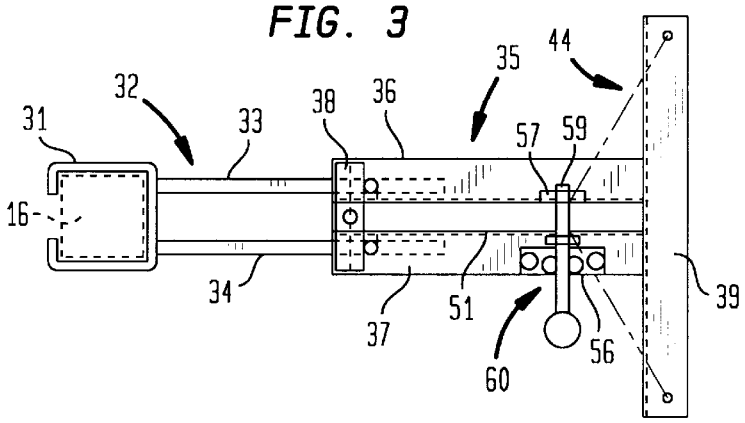
FIG. 3 a top view of the catch device in FIG. 2.
Figure 5:
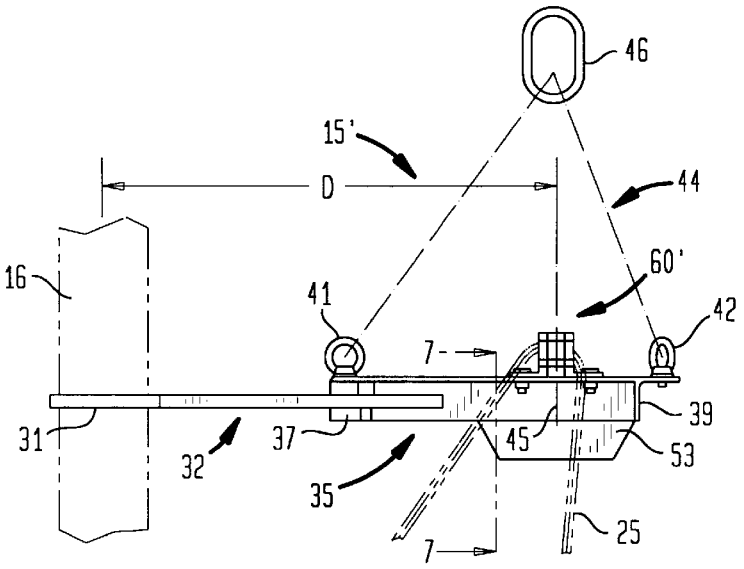
FIG. 5 a catch device for lifting a unit in accordance with with a preferred exemplary embodiment of the instant invention in an enlarged representation.
Figure 6:
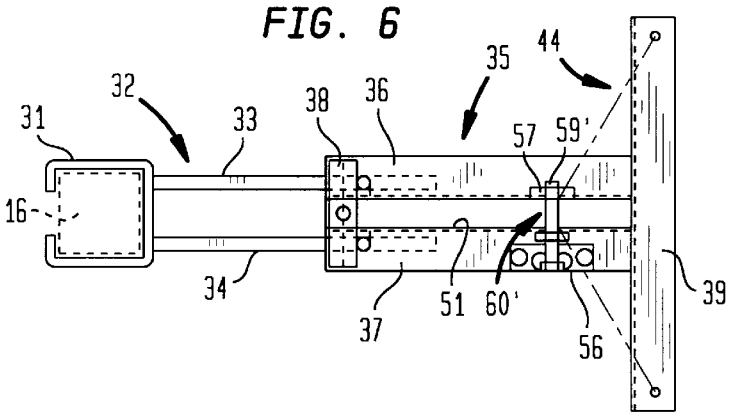
FIG. 6 a top view of the catch device in FIG. 5.

The catch device 15 for lowering the unit 11 and the catch device 15' for raising the unit 11 are identically constructed, except for their respective coupling elements 60 or 60'. Each catch device 15, 15' has a sliding claw 31 which is guided, upwardly and downwardly movable, along the upright pipe 16 of the guide device 12. The sliding claw 31 is provided with a collar 32 in the form of two parallel rods 33, 34, on which two parallel receptacles 36, 37 of a lifting gear 35 are slipped in a displaceable and arrestable manner. On their ends facing the collar 32, the two receptacles 36, 37 are connected with each other via a tie bar 38 and on the side facing away from it via a cross arm 39. Ring bolts 41 and 42 (FIGS. 2 and 5) are fastened on the center of the tie bar 38 and on both ends of the cross arm 39, in which a rope lashing 44 is suspended and brought together in a ring 46. A hook 47 of the pulling element 48 which, for example, is embodied as a pull rope or a pull chain, which is an element of the hoist, not further shown, is fastened in the ring.

Figure 4:
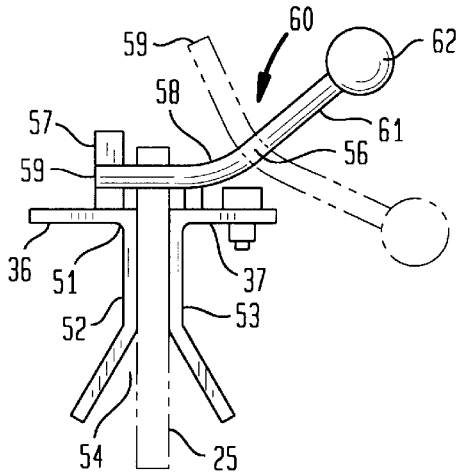
FIG. 4 a section along the line IV—IV in FIG. 2.
Figure 7:
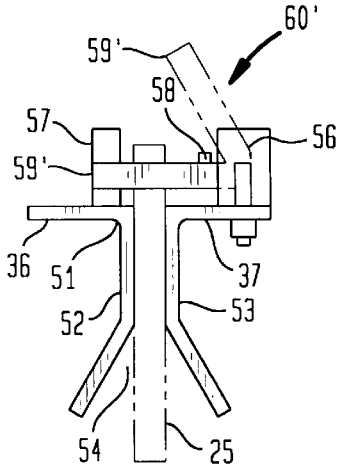
FIG. 7 a section along the line VII—VII in FIG. 2.

The tow receptacles 36, 37 of the lifting gear 35 delimit a receiver slot 51 for the lifting strap 25 of the unit 11 and on their lower end facing away from the rope lashing 44 they are provided with deflection plates 52, 53, which delimit a conical insertion opening 54 with their area facing away from the receptacles 36, 37. In the exemplary embodiment shown, the deflection plates 52, 53 are of one piece with the respective receptacle 36, 37 in FIGS. 4 and 7. The width of the receiver slot is sufficiently great to receive the lifting strap 25 of the unit 11. In accordance with a variant, not shown, the ends of the deflection plates 52, 53 are embodied in such a way that the insertion opening 54 is also delimited at the end.

The catch device 15 or 15' has a coupling element 60 or 60' in the form of a drop bar for lowering the unit 11, or in the form of a drop bar for raising the unit 11. Both the drop bar 60 for lowering and the drop bar 60' for raising are pivotably seated in a bearing fastened on the receptacle 37. A rest 57 is fastened on the receptacle 36 opposite the bearing 56, on which the free end 59, which faces away from the bearing shaft 58, of the drop bar 60 or 60' rests in the closed state. In the closed state, the drop bar 60 or 60' bridges the receiver slot 51 for the lifting strap 25 of the unit 11 in this way. The bearing 56 and the rest 57 with the drop bar 60 or 60' are arranged on the lifting gear 35 at the place 45 in which the axis of the center of gravity of the lifting gear 35 is located.

The drop bar 60 for lowering the unit 11 has an extension 61, which projects past the bearing shaft 58 and has a weight 62 at the end, which is designed in such a way that the drop bar 60 is maintained in its opened position, or automatically returns into the opened position from the closed position when its bar portion (between the bearing shaft 58 and the free end 59) is not weighted down. In contrast to this, the drop bar 60' for lifting the unit 11 is embodied as a flap, i.e. one-armed, so that it always tends to take up its closed position.

The function of the manipulating device 10 for simple locking and releasing the coupling unit 25 and 60 or 25 and 60' is as follows: for lowering the unit 11, the lifting gear 35 is brought outside of the respective reservoir, basin or the like over the unit 11 in such a way that the lifting strap 25 passes through the receiver slot 51 sufficiently far so that the drop bar 60 can be manually closed and kept closed, until after the raising of the lifting gear 35 the upper end of the lifting strap 25 rests on the portion of the closed drop bar 60 which bridges the receiver slot 51. In this state, in which the unit 11 is suspended by its strap 25 from the drop bar, the unit 11 is lowered by means of the manipulation device 10 and the hoist on the guide device 12 in the represented exemplary embodiment. As soon as the unit 11 is in its work position, i.e. rests on the detent 26, and the catch device 15 is lowered further, the free end 59 of the drop bar 60 comes clear of the lifting strap 25, so that the drop bar 60 can automatically open. If the catch device 15 is now raised again, the lifting strap 25 can come clear of the receiver slot 51 on the lifting gear 35 without hindrance. The unit 11 remains in its work position, while the catch device 15 can be removed.

For raising or taking the unit 11 out of the reservoir or basin or the like, the hoist, not shown in detail, is connected with the catch device 15', in place of the catch device 15. Catch device 15' contains the drop bar 60' and is lowered. During the lowering of the catch device 15', the lifting strap 25, passing between the deflection plates 52, 53, reaches the receiver slot 51 in the area of the work position of the unit 11 to be raised, wherein the upper end of the lifting strap 25 opens the closed drop bar 60'. AS soon as the upper end of the lifting strap 25 has passed sufficiently far through the receiver slot 51, the drop bar 60' can close again because of the inherent weight of the free end 59'. Following this, the catch device 15' is again pulled upward or raised, so that the upper end of the lifting strap 25 comes to rest on the bar portion of the closed drop bar 60' and can be lifted by means of the catch device 15'.

By means of the manipulating device 10 it is possible to raise or lower different units 11 operating in a basin or the like. For this reason the distance D between the drop bar 60 or 60' of the catch device 15 or 15' and the pipe 16 of the guide device 12 can be set in the described manner by means of the telescope-like connection of the bars 33, 34 with the receivers 36, 37.

It is also possible, particularly by means of the arrangement of the deflection plates 52, 53 on the side of the receiver slot 51 facing the lifting strap 25 of the unit 11, to employ the catch device 15 or 15' freely movable without the aid of the guide device 12. Something similar applies to the unit 11 which, if it has a suitable shape and seating surface, can be lowered or raised freely movable without the guide device 12 with the aid of such a manipulating device.

I claim:

1. A device for moving a submergible unit between a surface position and a submerged position, the unit being provided with a lifting strap, the device comprising:

two parallel receptacles connected via a tie bar and a cross arm, said receptacles defining between them a receiving slot for receiving the lifting strap of the unit, said two parallel receptacles including deflection plates for receiving the strap, wherein one of the two parallel receptacles includes a rest;

a coupling element pivotably attached to the other of the two parallel receptacles, said coupling element comprising a drop bar that bridges the receiving slot;

a guide device comprising an upright pipe;

holding means for holding the two parallel receptacles, said holding means comprising two parallel rods attached to a slidable claw, wherein said holding means move up and down relative to the guide device; and means for maintaining the coupling element in a first position, said means including a counterweight located at one end of the drop bar, wherein when the lifting strap is received in said receiving slot, the coupling element is independently moved to a second position, said drop bar being supported by said rest in the second position and thereby retained by engagement with said lifting strap, wherein the coupling element returns to the first position after the unit is placed in a submerged position.

2. The device of claim 1, wherein the drop bar is adjustably spaced from the guide device.

3. The device of claim 1, wherein the coupling element returns to the first position after a sufficient amount of strap has been received through the receiving slot.

4. A device for moving a submergible unit between a surface position and a submerged position, the unit being provided with a lifting strap, the device comprising:

two parallel receptacles connected via a tie bar and a cross arm, said receptacles defining between them a receiving slot for receiving the lifting strap of the unit, said two parallel receptacles including deflection plates for receiving the strap, wherein one of the two parallel receptacles includes a rest;

a coupling element pivotably attached to the other of the two parallel receptacles, said coupling element comprising a drop bar that bridges the receiving slot;

a guide device including a detent for receiving the unit in a submerged position;

holding means for holding the two parallel receptacles, wherein said holding means move up and down relative to the guide device;

said holding means including telescoping means for adjustable spacing the drop bar from the guide device; and means for maintaining the coupling element in a first position, said means including a counterweight located at one end of the drop bar, wherein when the lifting strap is received in said receiving slot, the coupling element is independently moved to a second position, said drop bar being supported by said rest in the second position and thereby retained by engagement with said lifting strap, wherein the coupling element returns to said first position after the unit is placed in a submerged position.

* * * * *